US006406203B1

(12) United States Patent
Maurer

(10) Patent No.: US 6,406,203 B1
(45) Date of Patent: Jun. 18, 2002

(54) COMBINATION WRITING INSTRUMENT AND PANEL

(76) Inventor: Bradley J. Maurer, 381 S. Drexel Ave., Bexley, OH (US) 43209

( * ) Notice: Subject to any disclaimer, the term of this patent is extended or adjusted under 35 U.S.C. 154(b) by 0 days.

(21) Appl. No.: 09/872,880

(22) Filed: Jun. 1, 2001

(51) Int. Cl.[7] ..... B43K 23/02

(52) U.S. Cl. ..... 401/131; 401/243; 401/202; D19/54; D19/57

(58) Field of Search ..... 401/131, 243, 401/195, 247, 202, 52, 48; D19/54, 57

(56) References Cited

U.S. PATENT DOCUMENTS

| | | | | | |
|---|---|---|---|---|---|
| 1,462,108 | A | * | 7/1923 | Holywell | 401/131 |
| D185,331 | S | * | 5/1959 | Tannenbaum | 401/131 |
| 4,699,536 | A | * | 10/1987 | Berman | 401/88 |
| D319,662 | S | | 9/1991 | Henry | |
| 5,105,949 | A | | 4/1992 | Blair | |
| D344,287 | S | | 2/1994 | Johnson | |
| 5,360,342 | A | | 11/1994 | Pardner | |
| 5,590,971 | A | | 1/1997 | Melnick | |
| D389,188 | S | * | 1/1998 | Conforti et al. | D19/57 |
| 6,247,865 | B1 | * | 6/2001 | Russell et al. | 401/202 |

* cited by examiner

*Primary Examiner*—David J. Walczak
(74) *Attorney, Agent, or Firm*—Jason H. Foster; Kremblas, Foster, Phillips & Pollick

(57) ABSTRACT

The combination of a writing instrument, a lanyard and a panel. The writing instrument has a cap and a body. The lanyard has an end attached to the cap, another end attached to the body, and an intermediate region extending between the two ends. The panel has an aperture through which the lanyard's intermediate region extends. The aperture is large enough to allow the lanyard intermediate region to pass freely through the aperture, yet the aperture is small enough to prohibit the cap and the body from passing through the aperture. The panel remains attached to the apparatus, although the panel can slide relative to the intermediate region of the lanyard.

20 Claims, 5 Drawing Sheets

COMBINATION WRITING INSTRUMENT AND PANEL

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO A "MICROFICHE APPENDIX"

(Not Applicable)

BACKGROUND OF THE INVENTION

1. Field of the Invention

This invention relates generally to writing instruments, and more particularly to writing instruments that have a cap and a body, such as a pen or a marker.

2. Description of the Related Art

Prior art inventions include a writing instrument having a structure to attach the cap in a manner that prevents loss of the cap. Examples of such inventions are shown in the following U.S. Patents: U.S. Pat. No. 5,590,971 issued Jan. 7, 1997 to Melnick on a "Marking Pen and Cap"; U.S. Pat. No. Des. 389,188 issued Jan. 13, 1998 to Conforti et al. on a "Cap Retainer and Assembly"; U.S. Pat. No. Des. 319,662 issued Sep. 3, 1991 to Henry on a "Combined Writing Instrument and Adjustable Cap Therefor", and; U.S. Pat. No. Des. 344,287 issued Feb. 15, 1994 to Johnson on a "Combined Pen, Chain and Wall-Mountable Bracket Therefor".

Other prior art inventions include a wall-mounted writing surface having a removable writing instrument, as in U.S. Pat. No. 5,105,949 issued Apr. 21, 1992 to Blair on a "Medicine and Record Holder". Still other prior art inventions include a board having multiple attached writing instruments and a medium for writing or coloring, as in U.S. Pat. No. 5,360,342 issued Nov. 1, 1994 to Pardner on a "Coloring Board with Attached Crayons".

The prior art cap attachment structures still permit the pen to be lost. No prior art apparatus is designed to retain a movably mounted, capped writing instrument to a writing surface to prevent this loss. In addition, no prior art structure is designed for a child to wear it around his or her neck or to hang it on a hook.

BRIEF SUMMARY OF THE INVENTION

The invention is an apparatus including a body and cap of a writing instrument. The apparatus also includes a lanyard that has a first end attached to the cap of the writing instrument, a second end attached to the body of the writing instrument, and an intermediate region extending between the ends. The intermediate region extends through an aperture of a panel, so that the writing instrument cannot be removed from the panel.

The apparatus is especially advantageous when used as a tool for reminding or teaching daily routines to children and other individuals in need of organization, such as when the panel has a writing surface displaying indicia representing routines or reminders. The lanyard connects together the writing instrument's body and cap and retains them with the panel. The lanyard can be looped around a person's neck or hung on a hook.

Figure 1:
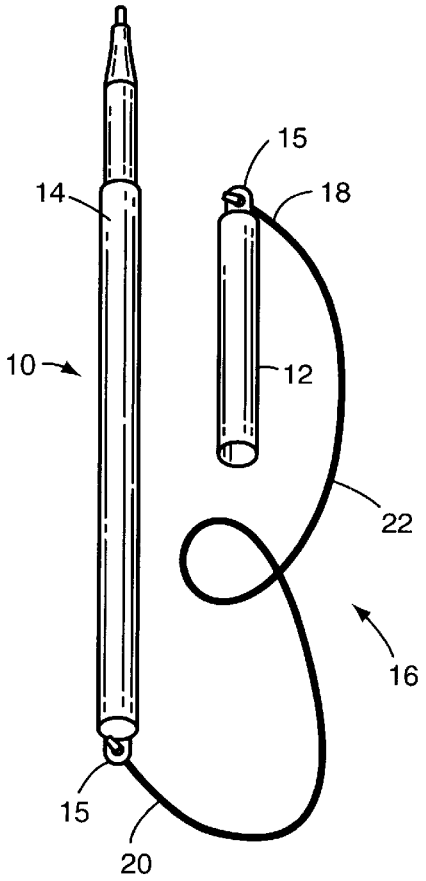
FIG. 1 is a side view illustrating an apparatus embodying the present invention, in which the writing instrument is uncapped.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents which operate in a similar manner to accomplish a similar purpose.

DETAILED DESCRIPTION OF THE INVENTION

Figure 2:
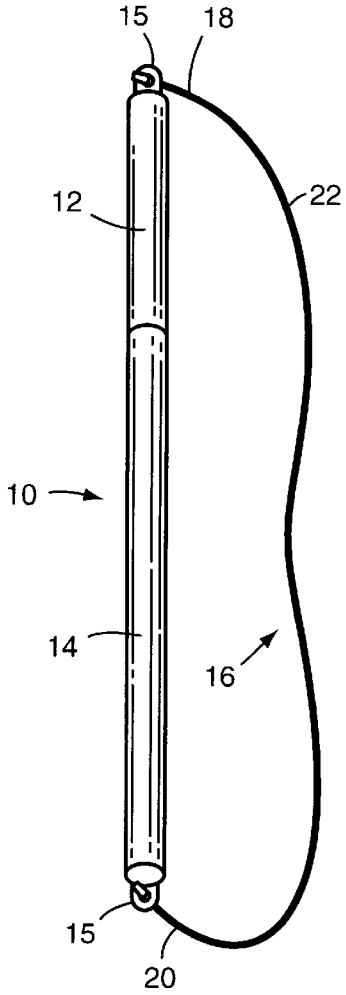
FIG. 2 is a side view illustrating the capped writing instrument.

Referring to FIGS. 1 and 2, a writing instrument 10 is shown having a cap 12 and a body 14. The writing instrument 10 is preferably a water washable marker but may be of any capped sort, including for example a pen, a dry-erase marker, or a capped pencil. A lanyard 16 has an intermediate region 22 extending between a first end 18 and a second end 20. The lanyard 16 may be any flexible attaching material such as string, yarn, wire, rope, cloth, cord, plastic or other strip, ribbon, band or light chain. Regardless of the material used, the lanyard must bend to enable a user to wear the apparatus around the neck or hang the apparatus on a hook.

The ends of the lanyard 16 are preferably removably attached to the writing instrument 10 but could be permanently fixed thereto or integral therewith. The cap 12 has a tab 15 to which the first end 18 of the lanyard 16 is attached, and the body 14 has a tab 15 to which: the second end 20 of the lanyard is attached. One attachment mechanism for attaching the lanyard to the cap 12 and to the body 14 is by a structure including a head 17*a*, a head base 17*d*, a neck 17*b*, and a shoulder 17*c*, which cooperate with an opening 15*a* on the tab 15, as illustrated in FIGS. 3*a–b*.

Figure 3A:
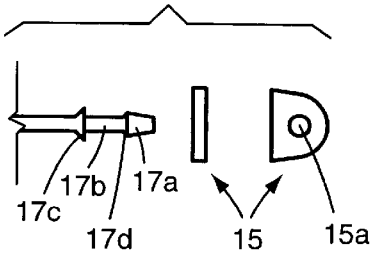
FIGS. 3*a–b* are enlarged views illustrating the cooperation between the preferred structures for attaching the lanyard to the writing instrument.
Figure 3B:
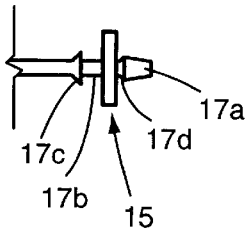

In operation of the structure illustrated in FIGS. 3*a–b*, the conical head 17*a* is extended through the opening 15*a* in the tab 15. The conical head 17*a* is compressed by the inner surface of the opening 15*a* as the head 17*a* is forced against the tab 15. This compressive force allows the head 17*a* to pass through the smaller diameter opening 15*a* due to deformation of the head 17*a* to that diameter at the wider region near the head base 17*d*, which otherwise has a diameter greater than the opening 15*a*. FIG. 3*a* shows the alignment of the head 17*a* and the tab 15 prior to insertion, and includes a cross section illustration of the tab 15.

FIG. 3*b* shows the structure after insertion in which the head base 17*d* rests against the edge of the opening 15*a* on a distal face of the tab 15. The head 17*a* is prohibited from backing out of the opening 15*a* under normal loading due to the large diameter of the head 17*a*. A user may more heavily load the lanyard 16 than under normal conditions by pulling ends 18 and 20, which will remove the head 17*a* from the tab 15. If the user applies this greater force to pull the head 17*a* back through the opening 15*a*, then the head base 17*d* will compress while passing through the opening 15*a*, despite the lack of an angled leading edge. This structural arrangement enables a user to remove the writing instrument 10 from the lanyard 16 such as for replacement of the pen when it runs out of ink. Of course, the user could remove the instrument from the lanyard by severing the lanyard and pulling it out in the same direction it was inserted.

In an alternative embodiment (not shown) of the attachment structure connecting the lanyard to the pen, the cap and the body are each formed with holes through them to which the lanyard is tied. Specifically, each lanyard end is threaded through respective holes on the cap and the body and then tied in a knot. Thus, the knot then acts in the same capacity as the head 17*a* as shown in FIGS. 3*a* and 3*b* to resist removal of the lanyard. Of course, any conventional connecting means could be used, including hooks with spring-loaded closures, which would permit easy removal of the lanyard without damage.

In another alternative embodiment (not shown) of the invention, each lanyard end has a tab integrally attached. The tab has an adhesive face for attaching to the respective portions of the writing instrument. In this embodiment, the writing instrument does not need to be formed with structures for receiving the lanyard, and the lanyard could be used with any conventional capped writing instrument.

In a still further alternative embodiment (not shown) of the invention, each lanyard ends are integral with the cap and the body. The writing instrument is formed with an integral lanyard during, for example, an injection molding process. Preferably, in this embodiment, the lanyard ends are molded to the ends of the cap and the body.

Figure 7:
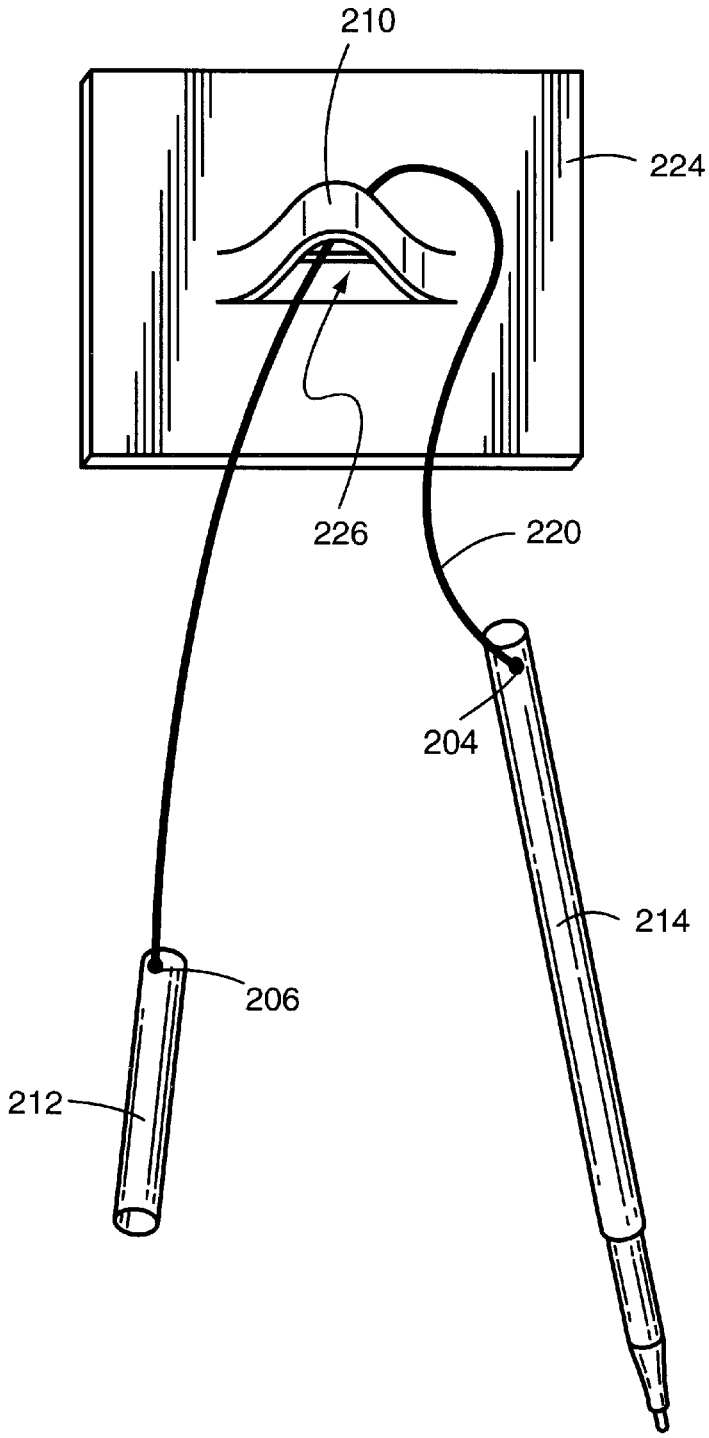
FIG. 7 is a view in perspective illustrating an alternative embodiment of the invention.
Figure 8:
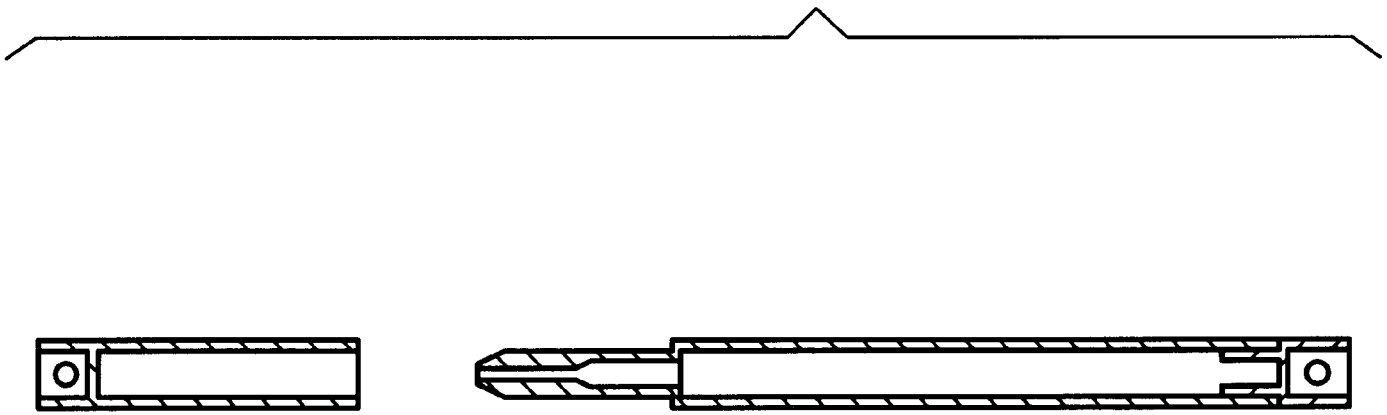
FIG. 8 is a side view in section of the pen of FIG. 7.

In another embodiment, shown in FIG. 7, holes 204 and 206 are formed in the pen body 214 and pen cap 212, respectively. The ends of the lanyard 220 have similar heads to those shown in FIGS. 3*a* and 3*b*, and are fastened in the holes 204 and 206. The lanyard 220 extends, at its midsection, through the aperture 226 between the raised loop 210 and the remainder of the panel 224. The panel 224 has an adhesive backing (not shown) and is similar to wire organizing devices sold in home centers and hardware stores.

In all embodiments of the invention, the intermediate region of the lanyard has a preferred length of 22–25 inches, which is a length sufficient to enable a user to wear the apparatus around his or her neck. Of course, any other length is possible, as long as it permits the cap to be placed on the writing instrument body. As a further limitation of lanyard length, referring to FIGS. 4 and 5, the length of the intermediate region 22 must preferably permit the tip of the attached writing instrument body 10 to reach a point on the writing surface of the panel 24 farthest away from the aperture 26 when the panel is to be a writing surface or is attached to an object that will serve as a writing surface. This ensures that a user is able conveniently to use the writing instrument 10 to mark on the panel 24.

Figure 4:
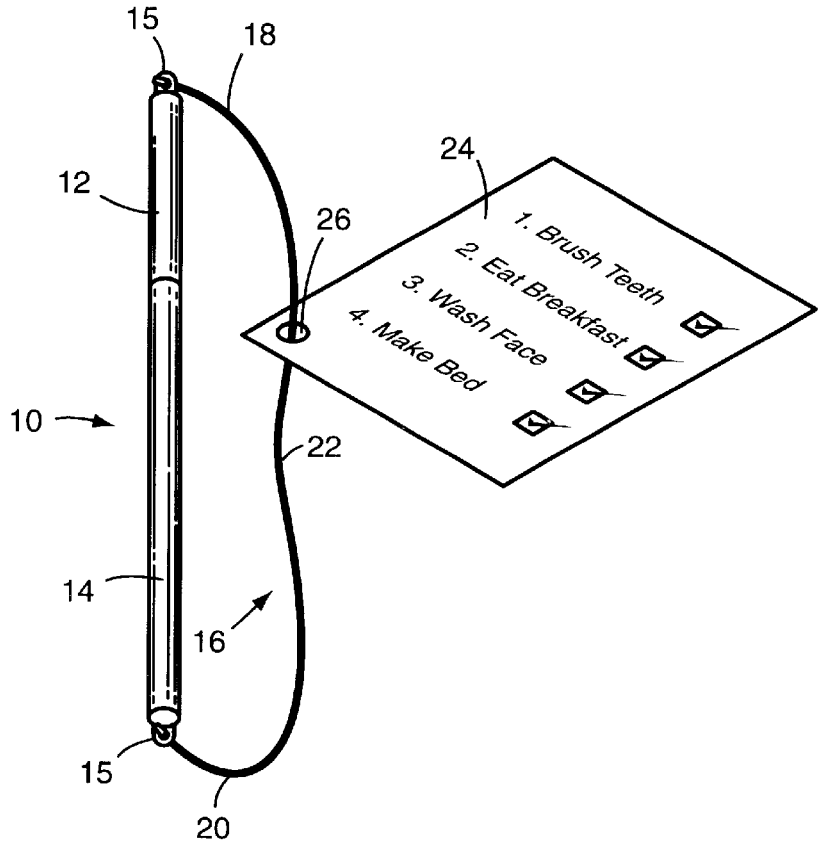
FIG. 4 is a side view illustrating an apparatus embodying the present invention, showing the capped writing instrument, the lanyard, and the panel.
Figure 5:
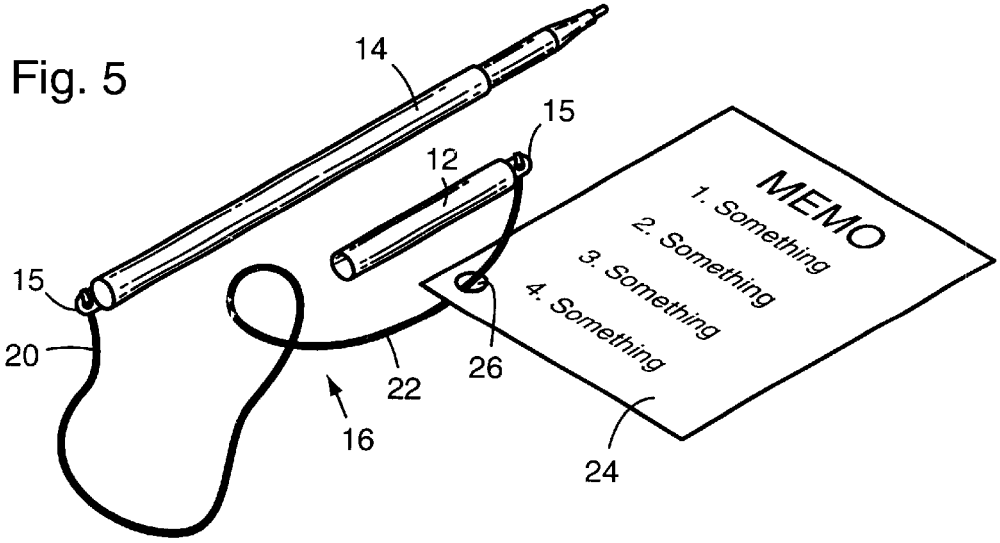
FIG. 5 is a side view illustrating an apparatus embodying the present invention, showing the aperture size in relation to the writing instrument size.

With reference to FIGS. 4 and 5, the intermediate region 22 of the lanyard extends through the aperture 26 formed in the panel 24. The panel 24 is a planar member with a thickness that is less than its length and its width. For example, the panel 24 may be printed plastic similar to a credit card in material and having a width of five inches, a length of seven inches, and a thickness of approximately 0.04 inches. Various structures may serve as the panel 24, but the preferred panel 24 includes a major writing surface having symbols or other indicia including special surfaces on which writing is possible. Alternatively, the panel 24 may be a clipboard or a book.

Still further, the panel 24 may be modified to enable performance of the invention in a specific environment. For example, a waterproofed version of the panel will perform outdoors or underwater, especially if it has regions that have been "roughened", such as by etching or sanding to form very small grooves that abrade and retain pencil lead, inks, etc. If a pencil is used to write in these roughened regions, water alone will not remove the lead, it must be washed out or erased.

Referring to FIGS. 4 and 5, the panel 24 has an aperture 26, through which the lanyard 16 extends, thereby "attaching" the lanyard and pen to the panel, although because of the aperture's size relative to the lanyard, the two structures can move relative to one another. As illustrated in FIG. 5, the aperture 26 is preferably formed through the panel 24 and has an area large enough to allow the intermediate region 22 of the lanyard to freely slide through it, yet small enough to prohibit the cap 12 and the body 14 from passing through it. In this combination the lanyard, cap and body cannot be removed from the panel 24 under normal use, because the cap 12, the body 14 and the lanyard 16 are all secured to the panel 24 by virtue of their cooperative connection together. This prevents the loss of any component part and permits hanging of the entire apparatus in a convenient place especially when the cap is on the pen body to form a closed loop.

Figure 6:
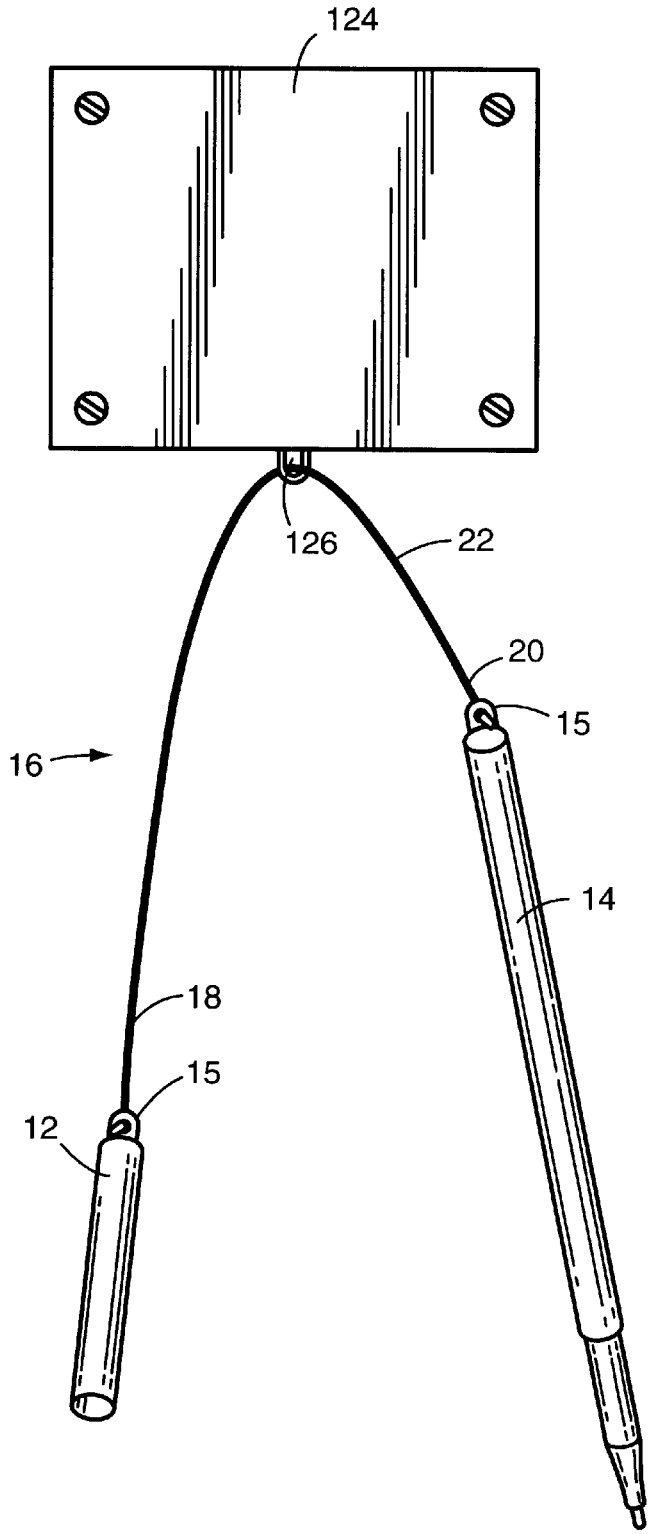
FIG. 6 is a front view illustrating an apparatus embodying the present invention, in which a mounted panel has an aperture that is a protruding loop.

Referring to FIGS. 6 and 7, the panels are significantly smaller than the panel 24 of FIGS. 4 and 5. The panel 124 of FIG. 6 and the panel 224 of FIG. 7 are preferably small plates that are to be mounted to a surface, such as a wall, a desk, a book, or a car dashboard where a writing instrument is needed. The panel 124 may be glued, taped, screwed, attached to complementary sides of hooks and loops material or otherwise permanently or temporarily mounted to the surface so that the pen, cap and lanyard combination can be conveniently combined with virtually any object where writing could occur.

The panel 124 has a protruding loop aperture 126 that is formed on an edge or a major face of the panel 124, but, of course, an aperture can be formed in the panel as in the preferred panel 24. Like the aperture 26, the protruding loop aperture 126 has an area large enough to allow the intermediate region 22 of the lanyard to freely slide through, yet small enough to prohibit the cap 12 and the body 14 from passing through. Thus, the entire writing instrument 10 cannot be removed from the panel 124 by passing the cap 12 or the body 14 through the aperture 26.

The FIG. 6 panel 124 also has a thickness less than its length and width. For example, the panel 124 can be one-eighth inch thick, one inch wide and two inches long.

While certain preferred embodiments of the present invention have been disclosed in detail, it is to be understood that various modifications may be adopted without departing from the spirit of the invention or scope of the following claims.

What is claimed is:

1. An apparatus comprising:

a. a writing instrument body having a writing tip;

b. a writing instrument cap that is removably mounted to the body over the tip;

c. a lanyard having a first end attached to the cap, a second end attached to the body, and an intermediate region extending contiguously from the first end to the second end; and d. a panel having an aperture through which the intermediate region extends, wherein the aperture is smaller than a largest part of the cap and smaller than a largest part of the body for preventing either of the cap and body from passing through the aperture.

2. The apparatus in accordance with claim 1, wherein the lanyard is a string.

3. The apparatus in accordance with claim 1, wherein the lanyard is a band.

4. The apparatus in accordance with claim 1, wherein the intermediate region has a length in a range between 22 and 25 inches.

5. The apparatus in accordance with claim 1, wherein the lanyard has a length permitting the tip of the body to contact a point on the panel farthest from the aperture.

6. The apparatus in accordance with claim 1, wherein the panel is printed plastic.

7. The apparatus in accordance with claim 1, wherein the panel has a thickness substantially less than its length and width.

8. The apparatus in accordance with claim 1, wherein the panel has indicia imprinted upon a major surface.

9. The apparatus in accordance with claim 1, wherein the panel is waterproof.

10. The apparatus in accordance with claim 9, wherein the writing instrument is waterproof.

11. The apparatus in accordance with claim 1, wherein the panel is a clipboard.

12. The apparatus in accordance with claim 1, wherein the panel is a book.

13. The apparatus in accordance with claim 1, wherein the panel is a plate that is removably attachable to a surface.

14. The apparatus in accordance with claim 13, wherein the aperture is formed in a loop extending from the plate.

15. The apparatus in accordance with claim 1, wherein the aperture is formed through the panel.

16. The apparatus in accordance with claim 1, wherein the cap and the body have a hole into which the lanyard extends for attaching the lanyard to the cap and the body.

17. The apparatus in accordance with claim 1, wherein the lanyard ends are integral with the cap and the body.

18. The apparatus in accordance with claim 1, wherein both the cap and the body have a tab with a tab aperture through which an end of the lanyard extends for attaching the lanyard to the cap and the body.

19. The apparatus in accordance with claim 18, wherein each of the lanyard ends has a head, a head base, a neck, and a shoulder for attaching the lanyard ends to the tabs.

20. An apparatus comprising:

a. a writing instrument body having a writing tip;

b. a writing instrument cap that attaches to the body;

c. a lanyard comprising:

i. a first end formed as a head, a head base, a neck, and a shoulder, wherein the first end is removably attached to the cap, and;

ii. a second end formed as a head, a head base, a neck, and a shoulder, wherein the second end is removably attached to the body, and;

iii. an intermediate region extending contiguously from the first end to the second end, and;

d. a panel comprising:

i. an aperture through which the intermediate region extends, the aperture having a size smaller than a largest part of the cap and a largest part of the body, and;

ii. a major surface including indicia.

* * * * *